United States Patent [19]

Koike et al.

[11] Patent Number: 4,646,664

[45] Date of Patent: Mar. 3, 1987

[54] CYCLIC SEWING MACHINE

[75] Inventors: Renji Koike, Toyota; Masayoshi Hattori, Chiryu, both of Japan

[73] Assignee: Aisin Seiki Kabushiki Kaisha, Kariya, Japan

[21] Appl. No.: 760,577

[22] Filed: Jul. 30, 1985

[30] Foreign Application Priority Data

Aug. 2, 1984 [JP] Japan ..... 59-163703

[51] Int. Cl.[4] ..... D05B 39/00; D05B 3/06

[52] U.S. Cl. ..... 112/67

[58] Field of Search ..... 112/65, 66, 67, 112, 112/448, 449, 76, 68

[56] References Cited

U.S. PATENT DOCUMENTS

| | | | |
|---|---|---|---|
| 2,822,771 | 2/1958 | Hale et al. | 112/65 |
| 2,938,477 | 5/1960 | Graham et al. | 112/67 |
| 3,117,542 | 1/1964 | Schen Kengel | 112/448 X |
| 3,428,006 | 2/1969 | Jindrich et al. | 112/67 |
| 3,635,179 | 1/1972 | Ueltschi | 112/448 |
| 3,705,561 | 12/1972 | Sakawa et al. | 112/67 |
| 4,181,083 | 1/1980 | Bajer et al. | 112/67 |

*Primary Examiner*—Werner H. Schroeder
*Assistant Examiner*—Andrew M. Falik
*Attorney, Agent, or Firm*—Burns, Doane, Swecker & Mathis

[57] ABSTRACT

A cyclic sewing machine includes a cam disc provided at opposite surfaces thereof with a first cam groove and a second cam groove, respectively. A first transmitting member has movement derived from the first cam groove operatively selectively imparted thereto and a second transmitting member has movement derived from the second cam groove selectively imparted thereto. First and second link mechanisms are connected to the first and second transmitting members, respectively. The cyclic sewing machine also includes a switching mechanism for selectively operatively connecting the first cam groove to the second link mechanism and the second cam groove to the first link mechanism, respectively. Thus, in the cyclic sewing machine, bar tacks may be rotated 90 degrees by manipulating the switching mechanism.

5 Claims, 7 Drawing Figures

CYCLIC SEWING MACHINE

BACKGROUND OF THE INVENTION

The present invention relates to a cyclic sewing machine, and more particularly to a cyclic sewing machine which is capable of sewing bar tacks or the like on a work piece with a certain number of stitches. In a conventional cyclic sewing machine of the type such as disclosed in U.S. Pat. No. 2,938,477, a cam disc for generating stitch patterns has to be replaced with a new disc upon rotating bar tacks through 90 degrees.

SUMMARY OF THE INVENTION

It is therefore, an object of the present invention to provide a cyclic sewing machine in which 90° rotation of bar tacks may be performed without replacing a cam disc.

This object and others are accomplished by a cyclic sewing machine according to the present invention. The machine includes a cam disc provided at opposite surfaces thereof with a first cam groove and a second cam groove, respectively. A first transmitting member has movement derived from said first cam groove selectively imparted thereto. A first link mechanism is operatively connected to the first transmitting member. A second transmitting member has movement derived from the second cam groove selectively imparted thereto and a second link mechanism is operatively connected to the second transmitting member. A holder is provided for holding a workpiece and is operatively connected to the first and second link mechanisms. A switching arrangement is provided for operatively connecting the first transmitting member and the second transmitting member to the second link mechanism and the first link mechanism, respectively.

BRIEF DESCRIPTION OF THE DRAWINGS

A preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
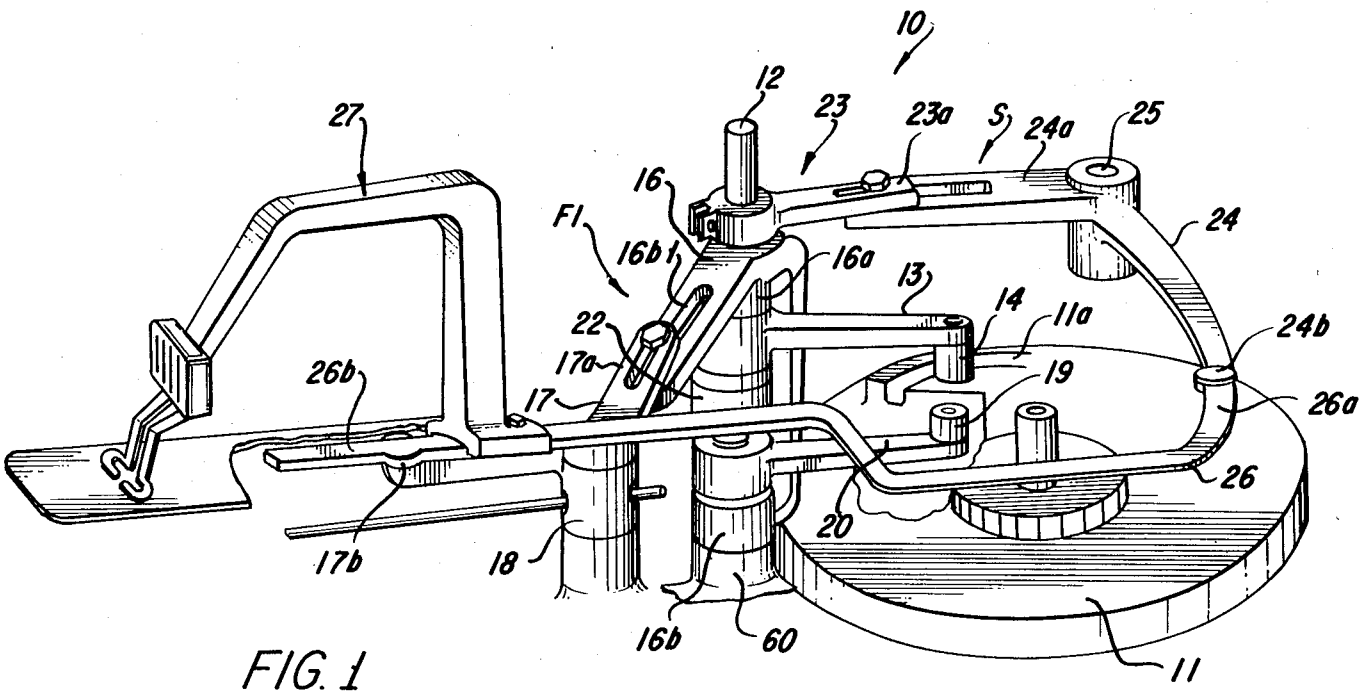
FIG. 1 is a perspective view of a cyclic sewing machine according to the present invention.
Figure 2:
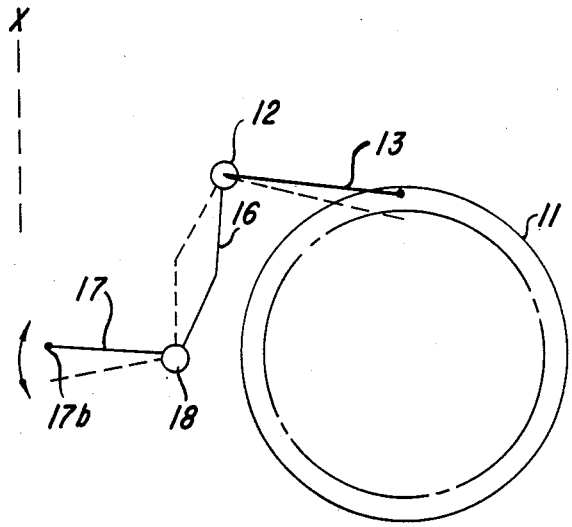
FIG. 2 is a view illustrating movement of a first link mechanism in the cyclic sewing machine.
Figure 3:
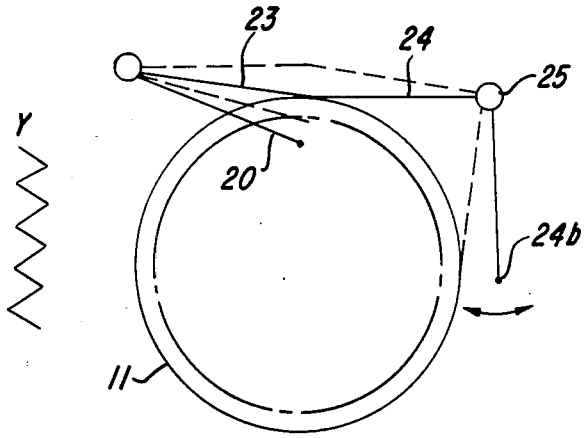
FIG. 3 is a view illustrating movement of a second link mechanism in the cyclic sewing machine.

With reference to FIGS. 1 through 7, a cyclically operated sewing machine 10, which is capable of sewing bar tacks, includes a cam disc 11 provided or formed at opposite surfaces thereof with a first cam groove 11*a* and a second cam groove 11*b*, respectively. A first transmitting member 13 is rotatably or swingably mounted through a boss portion 13*a* thereof on an upstanding shaft 12 which is rotatable relative to a base plate 60.

A roller 14, carried on a distal end portion 13*b* of the transmitting member 13, is arranged in the first cam groove 11*a* for tracking therewith. Thus movememt derived from the first cam groove 11*a* upon rotation of the cam disc 11 is imparted to the first transmitting member 13 resulting in movement of the transmitting member 13 that creates movement of a needle (not shown) to sew a desired stitch.

Figure 4:
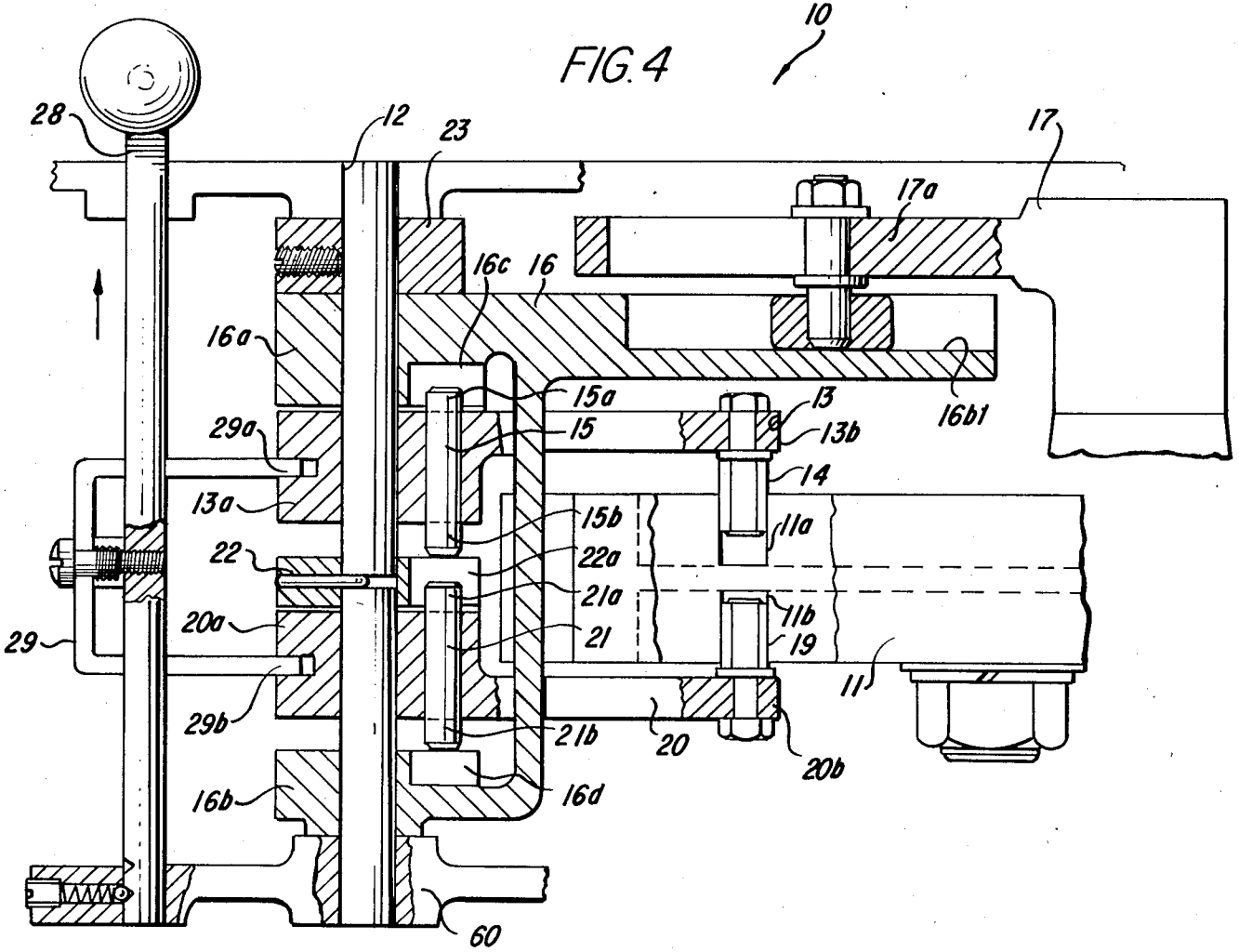
FIG. 4 is a view illustrating a switching arrangement in a first operative condition.

A pin 15 is driven in the boss portion 13*a* of the first transmitting member 13 and an upper end portion 15*a* of the pin 15 is adapted for selective engagement with a cavity 16*c* of a member 16 of a first link mechanism F1 (FIG. 1) in a first operative condition of the sewing machine (FIG. 4). A boss portion 16*a* of the member 16 is rotatably mounted on the shaft 12. A distal end portion 16*b*1 of the member 16 is in sliding engagement with a first portion 17*a* of a link member 17 which is rotatably mounted to a base portion 18. Thus, a second portion 17*b* of the link member 17 is brought into reciprocal movement about the base portion 18 in the direction indicated by the arrow in FIG. 2 upon swinging movement of the first transmitting member 16.

A roller 19, which is carried at a distal end portion 20*b* of a second transmitting member 20 is arranged in the second cam groove 11*b* for tracking therewith. Since a boss portion 20*a* of the second transmitting member 20 is rotatably or swingably mounted on the shaft 12, movement derived from the second cam groove 11*b* upon rotation of the cam disc 10 is imparted to the second transmitting member 20 resulting in swinging or oscillating movement thereof.

A pin 21 is driven in the boss portion 20*a* of the second transmitting member 20 and an upper end portion 21*a* of the pin 21 adapted for selective engagement with a hole or cavity 22*a* of the member 22 which is fixedly mounted on the shaft 12.

The member 16 has a branched boss portion 16*b* which is rotably or swingably mounted on the shaft 12 below the boss portion 20*a* of the second transmitting member 20.

Above the boss portion 16*a* of the first transmitting member 16, a link member 23 of a second link mechanism S is clamped on the shaft 12. A distal end portion 23*a* of the link member 23 is in sliding engagement with a first portion 24*a* of a link member 24 which is rotatable about a shaft 25. Thus, a second portion 24*b* of the link member 24 is brought into reciprocal movement about the shaft 25 in the direction indicated by the arrow in FIG. 3.

Figure 5:
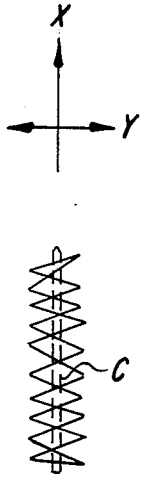
FIG. 5 is a view of a bar-tack derived from the mechanism of FIG. 4.

The second portion 17*b* of the link member 17 and a top portion 26*b* of a member 26 whose base portion 26*a* is pivoted to the second portion 24*b* of the link member 24 are connected to a holder 27 which holds a workpiece (not shown) to be sewn or stitched in a manner well known in the art, as by frictional engagement with the workpiece. See, for Example, U.S. Pat. No. 2,822,771 issued Feb. 11, 1958 and No. 2,938,477 issued May 31, 1960. Due to reciprocal lateral movement of the second portion 17*b* of the member 17 and reciprocal longitudinal movement of the top portion 26*b* of the member 26, bar tacks as shown in FIG. 5 are stitched. A central portion of the bar tack being represented in phantom lines by reference character C. The needle bar and looper are controlled in a known manner as illustrated, for example, in the above-mentioned U.S. patents which described the general construction and operation of a cyclic sewing machine.

A switching means 29 is provided for changing the sewing machine from the first operative condition to a second operative condition. The switching means 29 is fixed to a vertically movable shaft 28 and includes an upper panel 29*a* and a lower panel 29*b*. The upper panel 29*a* is connected to the boss portion 13*a* of the first transmitting member 13 and the lower panel 29*b* is connected to the boss portion 20*a* of the second transmitting member 20.

Upon downward movement of the shaft 28, both transmitting members 13 and 20 are simultaneously moved in the downward direction. This downward movement causes the upper end portion 15*a* of the pin 15 to be disengaged from the cavity 16*c* of the member 16, the lower end portion 15*b* of the pin 15 to be brought in engagement with the hole or cavity 22*a* of the member 22, the upper portion 21*a* of the pin 21 to be disengaged from the hole 22*a* of the member 22, and the lower portion 21*b* of the pin 21 to be brought into engagement with a cavity 16*d* in the branched boss portion 16*b* of the member 16.

Figure 7:
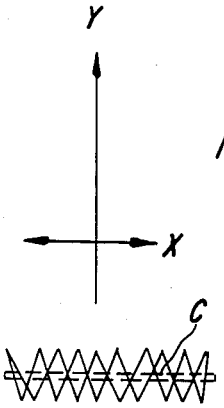
FIG. 7 is a view of a bar-tack derived from the mechanism of FIG. 6.
Figure 6:
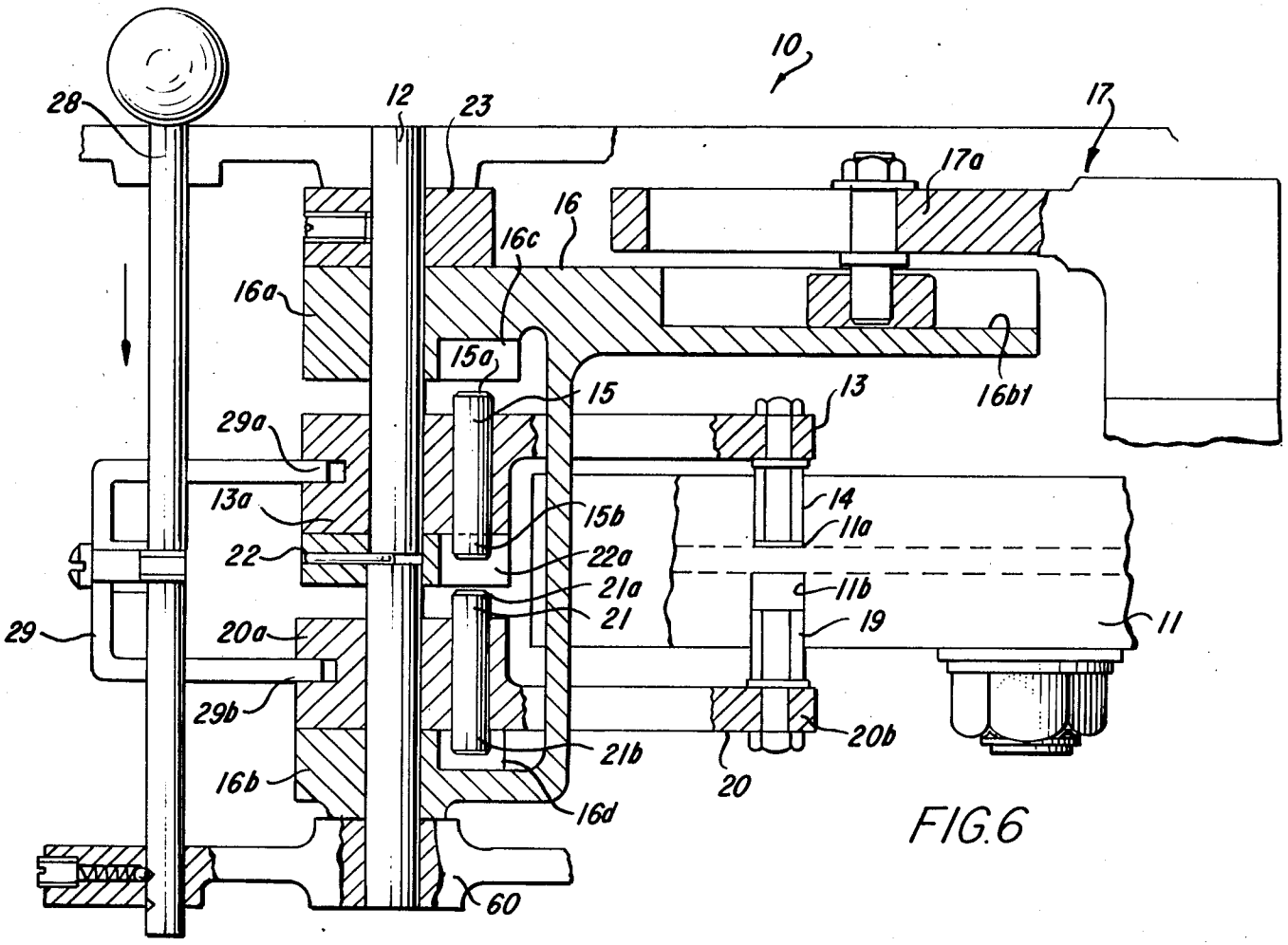
FIG. 6 is a view illustrating the switching arrangement in a second operative condition.

Accordingly, the movement derived from the first cam groove 11*a* and the movement derived from the second cam groove 11*b* are imparted to the second link mechanism S and the first link mechanism F1, respectively. Thus, the resulting bar tacks (as shown in FIG. 7) are rotated relative to the bar tacks shown in FIG. 5, wherein in each figure, reference character X represents the direction of stitching derived from movement of the first link mechanism and and reference character Y represents the direction of stitching derived from movement of the second link mechanism.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A cyclic sewing machine comprising;

a cam disc, a first cam groove provided on a first surface and a second cam groove provided on an opposite surface of the cam disc;

a first transmitting member having movement derived from said first cam groove imparted thereto;

a first link mechanism selectively operatively connected to said first transmitting member;

a second transmitting member having movement derived from said second cam groove imparted thereto;

a second link mechanism selectively operatively connected to said second transmitting member;

a holder for holding a workpiece, said holder being operatively connected to said first and said second link mechanisms; and switching means for selectively operatively connecting said first transmitting member and said second transmitting member to said second link mechanism and said first link mechanism, respectively.

2. The cyclic sewing machine of claim 1, further comprising pin means on each of said first and second transmitting members for selectively operatively connecting the first and second transmitting members to one of said first and second link mechanisms.

3. The cyclic sewing machine of claim 2, wherein said switching means includes means for simultaneously moving the pin means on the first and second transmirting members.

4. A cyclic sewing maching comprising;

a cam disc, a first cam groove provided on a first surface and a second cam groove provided on an opposite surface of the cam disc;

a first transmitting member having movement derived from said first cam groove imparted thereto;

a second transmitting member having movement derived from said second cam groove imparted thereto;

a first and a second link mechanism;

said first transmitting member being operatively connected to the first link mechanism and the second transmitting member being operatively connected to the second link mechanism in a first operative condition of the sewing machine, and the first transmitting member being operatively connected to the second link mechanism and the second transmitting member being operatively connected to the first link mechanism in a second operative condition; and switching means for selectively engaging the machine in the first or the second operative condition.

5. The cyclic sewing machine of claim 4, further comprising means for producing a sewn pattern, and wherein the pattern produced by the sewing machine is rotated 90° when the machine is switched from one operative condition to the other.

* * * * *